United States Patent [19]

Steimann

[11] 3,953,063

[45] Apr. 27, 1976

[54] COKE OVEN DOOR CLOSURE

[75] Inventor: Franz Steimann, Gelsenkirchen-Horst, Germany

[73] Assignee: Didier Engineering GmbH, Essen, Germany

[22] Filed: Dec. 9, 1974

[21] Appl. No.: 530,842

[30] Foreign Application Priority Data

Dec. 29, 1973 Germany ..... 2365191

[52] U.S. Cl. ..... 292/144; 292/260

[51] Int. Cl.[2] ..... E05C 21/02

[58] Field of Search ..... 292/259, 260, 158, 144

[56] References Cited

UNITED STATES PATENTS

| | | | |
|---|---|---|---|
| 1,490,777 | 4/1924 | LaFortune | 292/168 X |
| 2,203,817 | 6/1940 | Ferris | 292/166 |
| 2,234,575 | 3/1941 | Otto et al. | 292/259 |

*Primary Examiner*—Richard E. Moore

*Attorney, Agent, or Firm*—Wenderoth, Lind & Ponack

[57] ABSTRACT

A door closure includes a spring bearing member on a door body. A spring is positioned in the spring bearing member and urges a locking bar and locking bar support outwardly thereof into locking engagement with locking hooks. The spring bearing member is movable along the door body. A lever system is pivoted on the door body from a first position wherein the spring urges the locking bar into engagement with the locking hooks to a second position wherein the locking bar is out of engagement with and longitudinally spaced from the locking hooks.

12 Claims, 5 Drawing Figures

COKE OVEN DOOR CLOSURE

BACKGROUND OF THE INVENTION

The present invention relates to a door closure or fastening device for doors of ovens, in particular coke ovens, of the type including a compression spring producing the locking pressure positioned between a spring bearing or support member which is arranged on the body of the door, a locking bar that cannot be turned in relation to the door, and a locking bar support being shiftable toward the spring bearing member by a lever system, through which the locking bar can be moved away from the locking hooks.

In a door closure device of this kind, and as shown in German Pat. No. 687,175, the locking bar support consists of a pin or bolt that is guided by a locking bar, and a spring bearing, which includes a pot-shaped housing and a cover. These two parts of the spring bearing are attached to a holder on the door body by means of bolts or pins, such that the pot-shaped housing can be shifted transversely to the plane of the door on the pins. The door closure device is operated by a lever system, which is mounted on a door operating device that can be moved in front of the door. The lever system includes a plurality of rocking levers, that can be pressed through rollers mounted on their ends toward one another and/or against the face of the pin employed as the locking bar support, as well as against a pressure surface below the locking bar. The operation of these levers is effected in cooperation with two grippers that likewise belong to the lever system and can extend behind a transverse beam of the oven door.

This known door closure is associated with the disadvantages of being very expensive to construct and of requiring a large number of parts subjected to wear and bearings. Further, this known lever arrangement leads to the movement of the engagement points of the levers on the countersurface of the parts actuated by the levers. Therefore, it is necessary to provide rollers mounted on the levers for the transmission of the operating forces. Further, the known door closure must be equipped with adjusting means, in order to compensate for the manufacturing and assembly tolerances occurring both on the oven door and also on the door operating device. Even further, the adjustment of the initial tension of the spring which produces the locking force is a very complex operation.

Still further, the action of the operating forces in the form of pressure is disadvantageous in that in certain cases it may lead to twisting or other deformation of the parts of the door closure that are acted upon by such forces. Finally, the door closure can be operated only by means of the door operating machine which includes the lever system, so that an emergency operation of the door closure is practically impossible without the door operating machine. The same is true also for a simultaneous operation of a plurality of oven doors of a battery of ovens.

SUMMARY OF THE INVENTION

The primary object of the present invention is to overcome the above disadvantages and to produce a door closure of the type mentioned, but which possesses a simple, sturdy structure that is resistant to wear, which can be built in a simple manner, which is capable of simple and reliable operation, and which is as independent as possible of a door operating machine.

This object is achieved in accordance with the present invention by the provision of a lever system which is mounted on and connected to the body of the door, a spring bearing member, a locking bar support, and a sliding carriage guide arranged on the door body for guiding longitudinal movement of the spring bearing member.

Thus, the operation of the door closure merely requires an element capable of producing the necessary operating force, preferably a hydraulic operating cylinder, to engage a lever of the lever system mounted on the body of the door. Accordingly, it is possible to eliminate additional adjusting elements for the compensation of manufacturing and/or assembly tolerances of the device, as well as possible elements for absorbing reaction forces, since the latter are absorbed by the body of the door itself through the novel lever mounting arrangement. The operating element would generally be arranged on a door operating machine. However, it may also be arranged on any desired supporting frame or mount. This produces the possibility of operating the door closure in an emergency without the use of a door operating machine.

The door closure is expediently provided with a threaded bolt that can be screwed into the locking bar support, the compression spring resting against such bolt. The initial tension of the compression spring, and therewith the locking force of the door closure, can be adjusted readily and precisely by tightening or loosening the threaded bolt.

In accordance with a further feature of the invention, the locking bar support should consist of a pot-shaped extension of the locking bar, which is guided in the spring bearing member and which has an elongated groove or a plurality of such grooves uniformly arranged on the periphery thereof. Guide pins attached to the spring bearing member project into the grooves, whereby the locking bar support is guided reliably in the spring bearing member and secured against rotation.

An advantageous arrangement of the invention results when the lever system comprises a lever that is hinged to the door body, and when in the locking position is situated transverse to the plane of the door, a first pair of rods hinged at opposite ends thereof to the spring bearing member and to the lever, which first pair of rods are situated at small acute angles to the plane of the door and are connected between the ends thereof to a second pair of rods hinged to the locking bar support. The connection of the lever with the first pair of rods consists of a pin attached to the lever and guided through elongated holes in the first pair of rods. The lever system thus formed transmits the operating forces as tractive forces to the parts of the door closure connected thereto. As is well known, this is an advantage with regard to strength. The lever system pivots on the door body and first moves the locking bar and locking bar support against the spring to move the locking bar out of locking engagement with locking hooks. The lever system then moves the locking bar, locking bar support, spring and spring bearing member longitudinally along the sliding carriage guide.

BRIEF DESCRIPTION OF THE DRAWINGS

The following text explains in more detail two exemplified embodiments of the invention, with reference to the attached drawings, wherein.

DETAILED DESCRIPTION OF THE INVENTION

Figure 1:
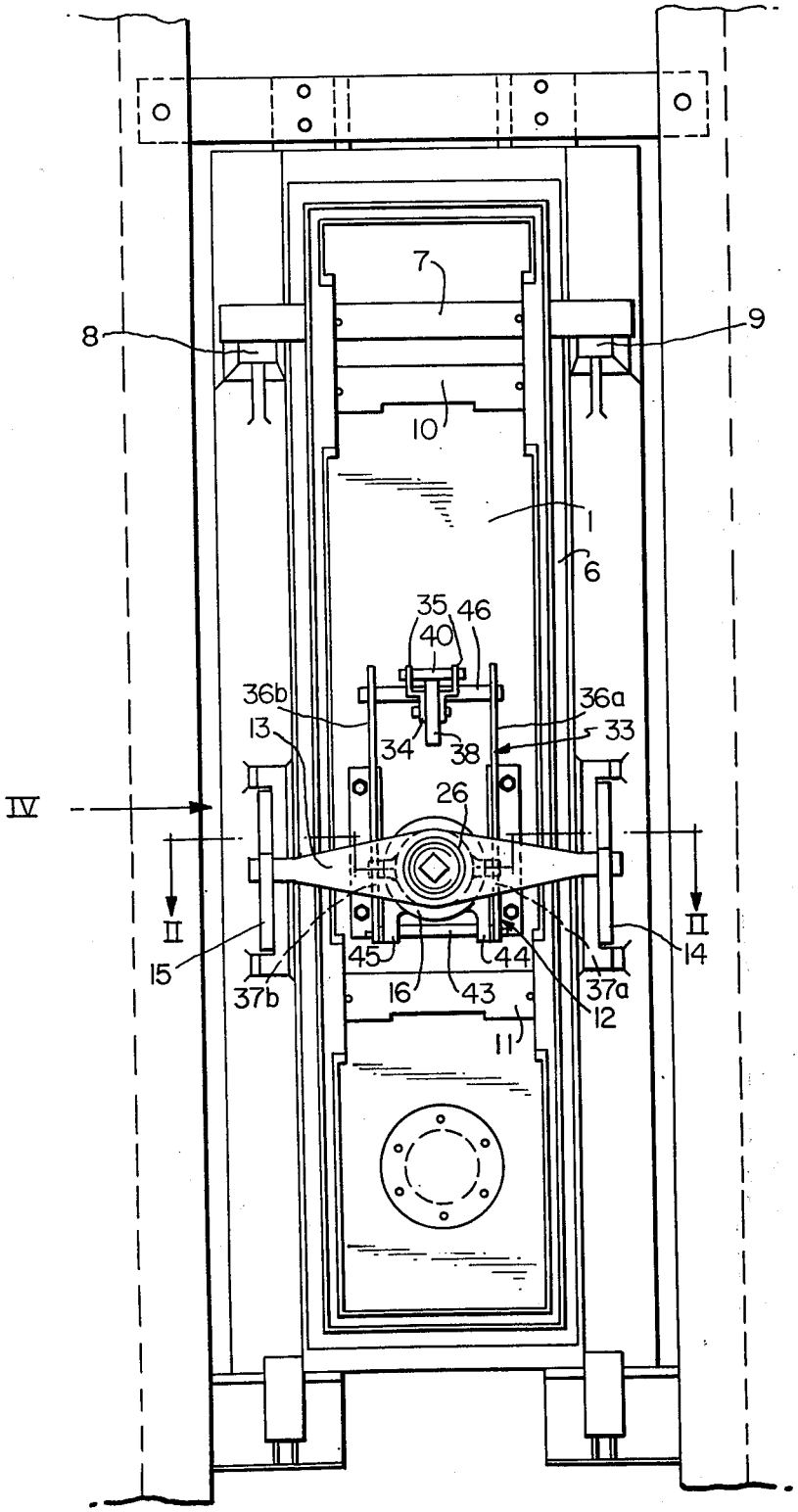
FIG. 1 is a frontal elevation of a coke oven door, the door closure of which is shown in the locking position.
Figure 2:
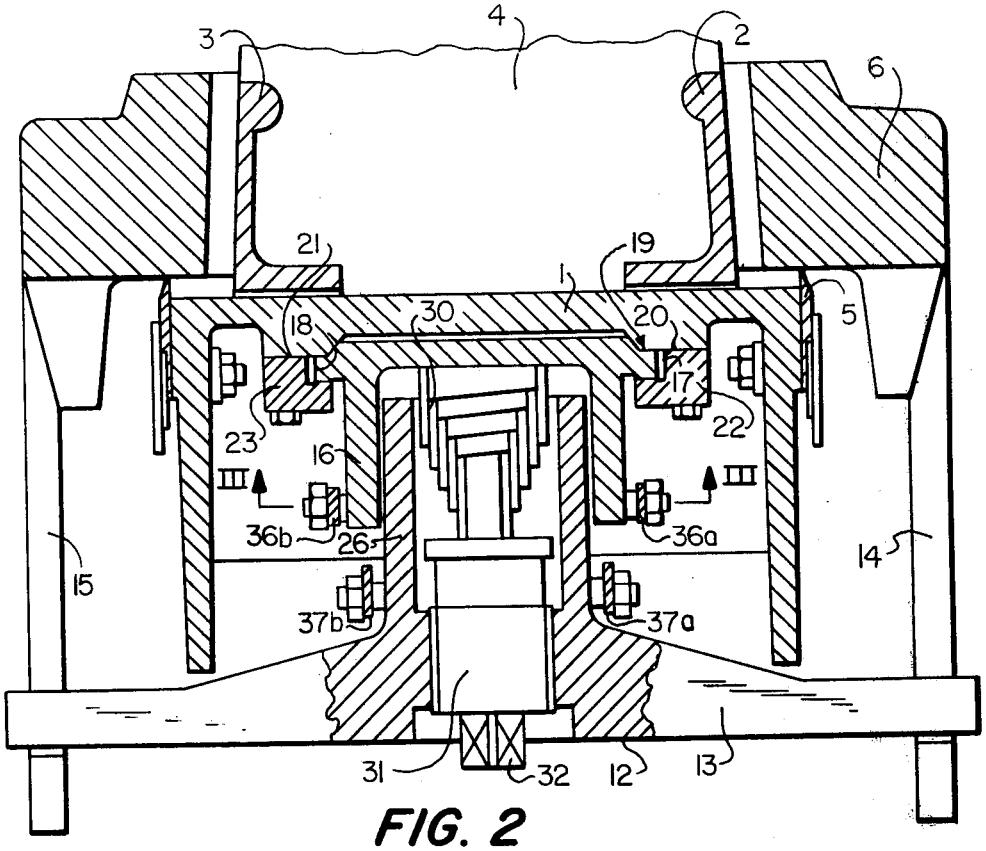
FIG. 2 is a section through the door closure taken along the lines II—II of FIG. 1.
Figure 3:
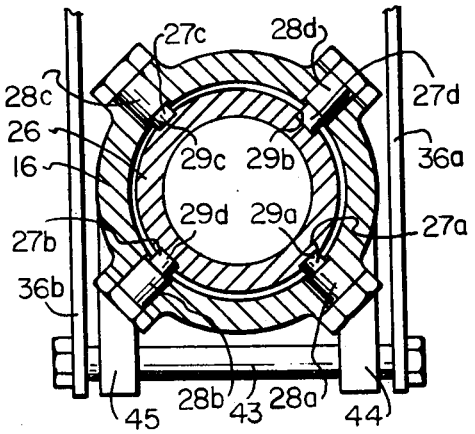
FIG. 3 is a partial section through the door closure taken along the lines III—III of FIG. 2.

The oven door shown in FIGS. 1 and 2 includes a door plate 1 and brace elements 2 and 3, with which a refractory lining 4 is kept in place.

Further, the oven door has a sealing frame or member 5, which is pressed against a door frame 6 in the illustrated closed position of the door to seal the door with the frame.

The oven door can be mounted on the oven by means of a transverse support 7, attached to door plate 1, which rests on two projections 8 and 9 on the front wall of the oven. Two further transverse supports 10 and 11 are employed for lifting the oven door by means of a known door operating machine, not illustrated, the gripping arms of which can extend behind transverse supports 10 and 11.

The oven door can be closed by means of a door closure or fastening device 12. The closure includes a locking bar 13, the opposite arms of which engage locking hooks 14 and 15 on door frame 6.

Further, door closure 12 includes a pot-shaped spring bearing or support member 16 having opposite longitudinal guide ribs 17 and 18. Spring bearing member 16 is guided during longitudinal displacement with respect to door plate 1 by means of a sliding carriage guide 19. Sliding carriage guide 19 consists of two guide rails 20 and 21 integral with door plate 1 and two guide rails 22 and 23 attached to door plate 1. Guide ribs 17 and 18 of spring bearing member 16 project into spaces between guide rails 20 and 22 and guide ribs 21 and 23, respectively.

Locking bar 13 is provided with a pot-shaped extension 26, which is employed as a locking bar support and which can be displaced into spring bearing member 16 in a direction transverse to the plane of the door. However, locking bar support 26 is guided within spring bearing member 16 without the possibility of turning in relation to the door. Four guide pins 27*a*, 27*b*, 27*c* and 27*d* are employed for guiding locking bar support 26 in such a manner that it cannot turn. Uniformly distributed over the periphery of support 26, the pins are threaded by respective threaded portions 28*a*, 28*b*, 28*c* and 28*d* into spring bearing member 16 and project into respective grooves 29*a*, 29*b*, 29*c* and 29*d* of locking bar support 26. It is to be understood that other means could be provided for preventing rotation of support 26.

In spring bearing member 16, there is arranged a buffer spring 30, which produces the locking force for the door closure of the oven door. Spring 30 is compressed between spring bearing member 16 and a threaded bolt 31 having an outer attachment end such as square end 32 and screwed into locking bar support 26. Spring 30 forces support 26 and door closure 12 outwardly from door plate 1 and into contact with locking hooks 14 and 15. The initial tension of buffer spring 30 can be adjusted by tightening or loosening, i.e. screwing inwardly or outwardly, threaded bolt 31, which is done by means of a suitable tool that is attached to square end 32. The locking force exerted by the buffer spring can be easily and accurately adjusted in this manner. Of course, a coil spring may be used in place of buffer spring 30.

Further, door closure 12 contains a lever system 33, consisting of a forked lever 34 having two arms 35, as well as two pairs of rods 36*a* and 36*b* and 37*a* and 37*b* (FIGS. 1 to 4). Lever 34 is hinged at one of its ends by means of a pin 39 to an extension 38 of door plate 1. At its other end, lever 34 is provided with a further pin 40 mounted in arms 35. Pin 40 can be engaged by a lever-operation device, preferably an operating rod 41 of a hydraulic operating cylinder 42, that is shown only in part and which is an integral element of a known door operating machine.

Rods 36*a* and 36*b* are hinged, at first ends thereof, to opposite lateral sides of spring bearing member 16 by means of a pin or bolt 43, which is mounted in two extensions 44 and 45 of spring bearing member 16. Rods 36*a* and 36*b* are connected at second ends thereof to lever 34 by means of a pin 46, which is attached to lever 34, and which is guided by longitudinal holes 47*a* and 47*b* in respective rods 36*a* and 36*b*.

Rods 37*a* and 37*b* are connected, at first ends thereof, to opposite lateral sides of locking bar support 26 by means of pins or bolts, of which pin 48*b* is shown. Rods 37*a* and 37*b* are connected at second ends thereof to rods 36*a* and 36*b*, respectively, by means of pins or bolts, of which pin 49*b* is shown. The pins associated with the connection of rod 37*a* are mirror images of pins 48*b* and 49*b*.

Lever 34 and rods 36*a* and 36*b* and 37*a* and 37*b* are so mounted and dimensioned that, in the illustrated closed position of the door, lever 34 is situated substantially at a right angle to the plane of the door, while rods 36*a* and 36*b* extend at a small acute angle to such plane, and rods 37*a* and 37*b* are situated perpendicularly to the plane of the door and in a diametral plane of spring bearing member 16.

In FIGS. 1 to 4, door closure 12 is shown in the locked position. In order to unlock the door, an operating force is exerted on pin 40 of lever 34 by means of operating cylinder 42, and lever 34 is pivoted into the position shown by the dashed lines by such a force. Rods 36*a* and 36*b* and 37*a* and 37*b* are thereby moved by lever 34 in such a manner that during the first phase of such movement, the pivoting movement of lever 34 effects a shifting of locking bar support 26 inwardly toward spring bearing member 16 to compress spring 30. This initial inward shifting is due to the provision of longitudinal holes 47*a* and 47*b*. Further pivoting of lever 34 causes spring bearing member 16, as well as locking bar support 26 and locking bar 13, to be displaced along sliding carriage guide 19. However, such displacement occurs only after the locking force produced by spring 30 is removed. Locking bar support 26 mounted in the spring bearing member 16, together with locking bar 13, move with spring bearing member 16, and therefore locking bar 13 is moved clear of locking hooks 14 and 15, and the oven door is unlocked.

In order to lock the door, it is only necessary to remove the operating force, i.e. the force of operating cylinder 42. This action releases compressed compression spring 30, and lever system 33 is brought into the original starting position by the force of spring 30, whereat locking bar 13 is pressed through compression spring 30 against locking hooks 14 and 15.

Figure 5:
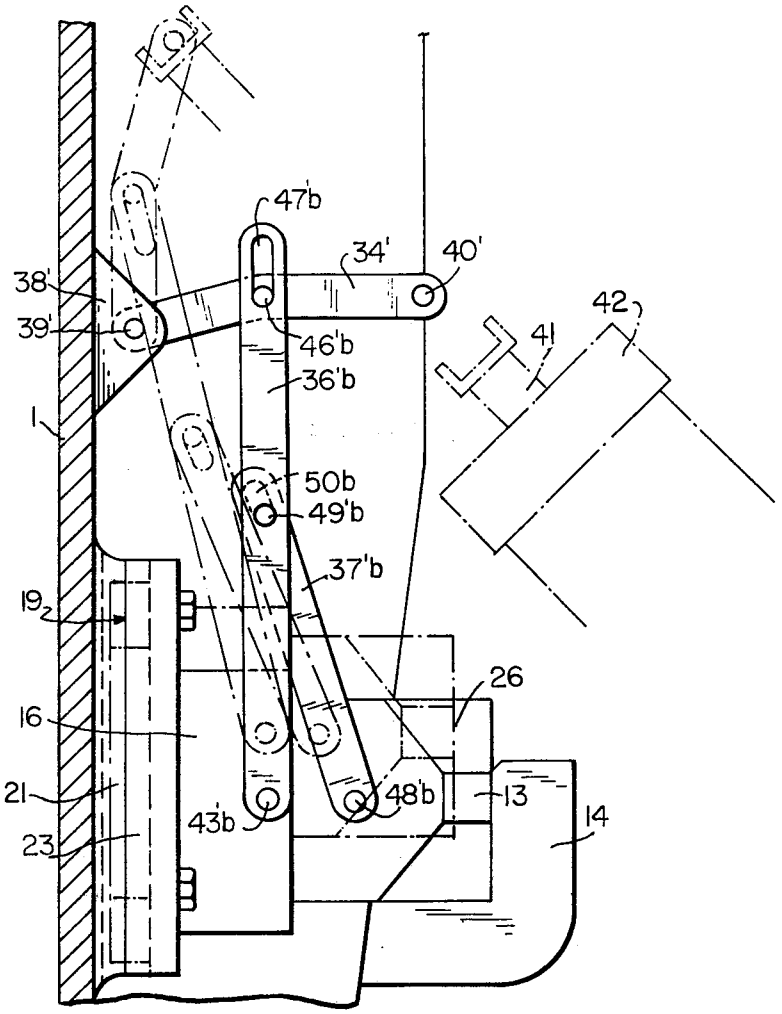
FIG. 5 is a view similar to FIG. 4, but of a modified embodiment.
Figure 4:
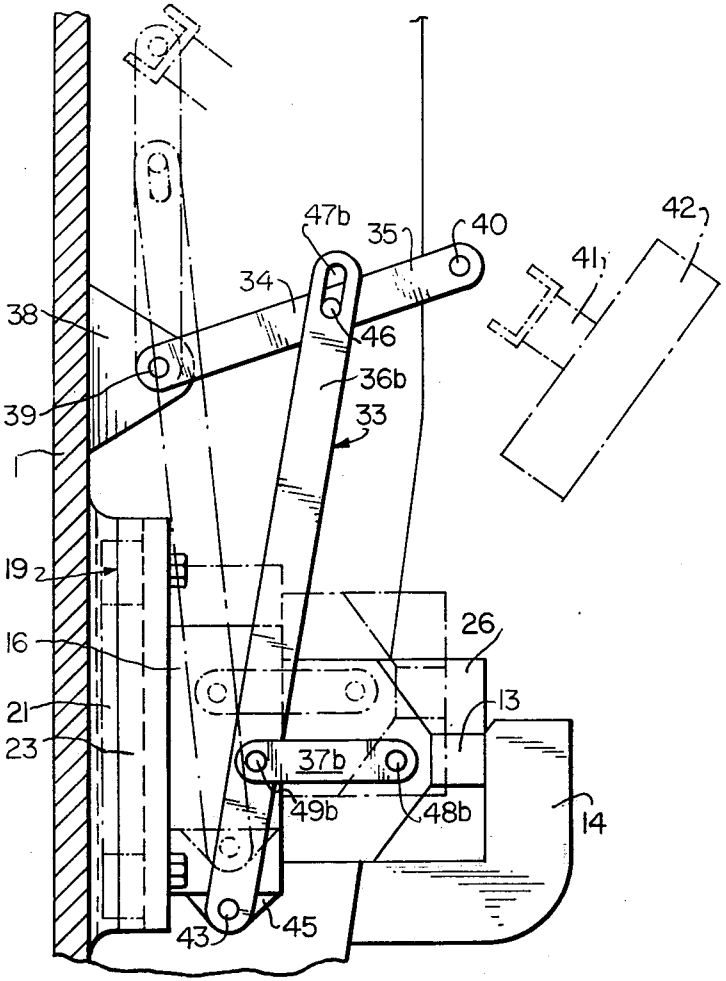
FIG. 4 is a side elevation of the door closure taken in the direction of arrow IV in FIG. 1.

The embodiment of the lever system for operating door closure 12 shown in FIG. 5 differs from the embodiment shown in FIG. 4 merely through the arrangement of the rods hinged to the locking bar support 26. Identically formed parts of the door closure in FIG. 5 are designated with the same reference numerals as in FIGS. 1 to 4, but the corresponding parts of the lever system are designated by a prime in FIG. 5.

In contrast with lever 34 of FIG. 4, a lever 34' of FIG. 5 is constructed as an elbow shaped or bent lever. Rods 36'*a* and 36'*b* are hinged to spring bearing member 16 in a central diametral plane thereof by means of pins, of which pin 43'*b* associated with rod 36'*b* can be seen. The pin associated with rod 36'*a* is arranged symmetrically. Rods 37'*a* and 37'*b* are each provided with an elongated hole at the ends thereof connected to rods 36'*a* and 36'*b*, a pin being guided through each elongated hole. FIG. 5 shows longitudinal hole 50*b* associated with rod 36'*b*, and a respective pin 49'*b*. The elongated hole associated with rod 36'*a* and the pin which passes through such a hole are arranged symmetrically. The hinge points and the length of rods 37'*a* and 37'*b* are selected such that rods 37'*a* and 37'*b* form small acute angles with rods 36'*a* and 36'*b*, respectively.

The operation of the lever system of FIG. 5 does not substantially differ from the operation of the lever system of FIG. 4. When lever 34' is pivoted toward door plate 1 by means of operating cylinder 42, locking bar support 26 is first moved into spring bearing member 16, and the locking force exerted by buffer spring 30 on locking bar 13 is thus removed. During further pivoting of lever 34', spring bearing member 16, together with locking bar support 26 and locking bar 13, is then moved longitudinally out of the range of locking hooks 14 and 15, whereby the door of the oven is unlocked.

The described door closure is characterized by a structure which consists of a relatively small number of simple and sturdy parts and which guarantees a reliable guide and support of the movable parts. Such parts are operated by means of a lever system, which is likewise very simple in construction, its operating rods being subjected substantially only to tractive forces. Further, the lever system of the invention effects a functional and desired sequence of movement, whereby the locking force between locking bar 13 and locking hooks 14 and 15 is first removed, and subsequently the locking bar is moved out of range of the hooks. The lever system also effects a transmission of power which makes it possible to work with a required operating force to unlock the door that amounts only to a fraction, e.g. 30%, of the desired and actual locking force.

Still further, the door closure of the invention possesses the advantage of being independent, except for the operating means that produce the operating force to be exerted on the lever system. This makes it possible to operate the door independently of the door operating machine by means of any operating element which is capable of applying the required operating force, e.g., a hydraulic cylinder mounted on a supporting frame. Therefore, it is also possible with relatively low expenditure to operate simultaneously a plurality of door closures arranged on different doors.

It will be understood that various modifications can be made to the specific structural elements described above without departing from the spirit and scope of the invention.

What is claimed is:

1. In oven doors, particularly coke oven doors, of the type including a door frame, a door body and locking hooks associated with the door frame for cooperation with a door closure device to lock the door body with respect to the door frame; the improvement wherein said door closure device comprises:

a spring bearing member on said door body;

a locking bar engageable with said locking hooks when said door body is in the locked position;

said locking bar having a locking bar support extending toward said spring bearing member;

a compression spring positioned between said spring bearing member and said locking bar support and urging said locking bar support and locking bar away from said spring bearing member;

a sliding carriage guide on said door body, said spring bearing member being mounted in said sliding carriage guide for longitudinal sliding movement therein along a direction parallel to the plane of said door body; and a lever system mounted on said door body and hingedly connected to said spring bearing member and said locking bar support.

2. A door closure device as claimed in claim 1, further comprising adjusting screw means threaded through said locking bar support and contacting said spring for selectively adjusting the compressive force of said spring.

3. A door closure device as claimed in claim 1, wherein said spring bearing member is pot-shaped; said locking bar support is pot-shaped and extends into said spring bearing member; said spring being positioned within said spring bearing member and said locking bar support; and further comprising means for preventing relative rotation between said spring bearing member and said locking bar support.

4. A door closure device as claimed in claim 3, wherein said rotation preventing means comprises at least one groove in the outer periphery of said pot-shaped locking bar support and at least one guide pin mounted in said spring bearing member and projecting into said at least one groove.

5. A door closure device as claimed in claim 1, wherein said sliding carriage guide comprises rails on said door body; said spring bearing member having ribs engaging said rails and movable therealong.

6. A door closure device as claimed in claim 1, wherein said lever system is mounted on said door body for pivotal movement from a first position wherein said spring urges said locking bar into locking engagement with said locking hooks to a second position wherein said locking bar is out of engagement with and longitudinally spaced from said locking hooks.

7. A door closure device as claimed in claim 6, wherein said lever system comprises means for, as said lever system is pivoted from said first position to said second position, initially moving said locking bar and locking bar support toward said spring bearing member against said spring, and then moving said locking bar, said locking bar support, said spring and said spring bearing member longitudinally of said door body along said sliding carriage guide.

8. A door closure device as claimed in claim 7, wherein said means for moving comprises a lever pivotally mounted on said door body; first rods hinged at first ends thereof to said lever and hinged at second ends thereof to said spring bearing member; and second rods hinged at first ends thereof to said first rods and hinged at second ends thereof to said locking bar support.

9. A door closure device as claimed in claim 8, wherein said first rods have at said first ends thereof elongated openings, said first rods being hinged to said lever by said elongated openings.

10. A door closure device as claimed in claim 9, wherein when said lever system is in said first position, said lever extends substantially transversely of the plane of said door body; and wherein said first rods extend at a slight acute angle to said plane of said door body.

11. A door closure device as claimed in claim 10, wherein said second rods extend substantially transverse to said plane of said door body.

12. A door closure device as claimed in claim 10, wherein said second rods have at said first ends thereof elongated openings; said second rods being hinged to said first rods by said elongated openings; and said second rods extending at a slight acute angle to said first rods.

* * * * *